United States Patent [19]

Smith

[11] 4,215,432

[45] Aug. 5, 1980

[54] ROLL OF DISPOSABLE APRONS

[76] Inventor: Dennis B. Smith, 2312 Galen Dr., Champaign, Ill. 61820

[21] Appl. No.: 954,091

[22] Filed: Oct. 24, 1978

[51] Int. Cl.[2] ..... A41B 13/10

[52] U.S. Cl. ..... 2/48

[58] Field of Search ..... 2/48, 49 R, 49 A, 50, 2/51, 52, 243 B, DIG. 7

[56] References Cited

U.S. PATENT DOCUMENTS

| | | | |
|---|---|---|---|
| 1,618,208 | 2/1927 | Lichter | 2/51 |
| 3,496,815 | 2/1970 | Ruhl | 2/48 |
| 3,815,153 | 6/1974 | Vitol | 2/51 |
| 3,851,760 | 12/1974 | Smith | 2/49 R |
| 3,995,321 | 12/1976 | Johnson | 2/49 R |

*Primary Examiner*—Werner H. Schroeder
*Assistant Examiner*—Doris L. Troutman
*Attorney, Agent, or Firm*—David V. Munnis

[57] ABSTRACT

Roll of disposable aprons formed of flat, unfolded strip of plastic monofilm or film laminate having spaced, transverse perforations and predetermined cut-out areas and packaged in a roll from which discrete aprons can be removed by tearing at the longitudinal perforations, with the resultant aprons, without any further tearing or unfolding, having neck holes and tie straps and being directly ready for donning by users.

16 Claims, 2 Drawing Figures

ROLL OF DISPOSABLE APRONS

BACKGROUND OF THE INVENTION

This invention relates to improved disposable plastic aprons, and, more particularly, to an improved roll of disposable plastic aprons which, upon removal from the roll by tearing, are in a form adapting them for direct utilization.

A wide variety of disposable bibs and aprons have been proposed in the prior art, with such bibs and aprons including articles made of paper and plastic films, those disclosed in U.S. Pat. Nos. 2,262,010; 2,424,680; 2,756,430; 2,763,867; 3,001,646; 3,131,399; 3,221,341; and 3,735,865. Such prior art articles, however, suffer from one or more drawbacks and disadvantages stemming from inadequate strength, requiring supplemental tabs attached by heat sealing, adhesives, sewing, etc., with an attendant increase in investment and operating costs, and/or providing for a necessary removal of portions prior to use, resulting in a waste of material and a failure to provide a directly useable product. Hence, a search has continued in the art for an improved disposable apron which is adapted to be cheaply and simply manufactured and to be directly useable.

OBJECTS OF THE PRESENT INVENTION

Accordingly, it is the primary object of the present invention to provide an improved roll of disposable aprons.

Another object of the present invention is to provide an improved roll of disposable aprons which may be more economically and simply manufactured as compared to prior art apron rolls, yet which are advantageously adapted to be directly used by a wearer.

An additional object of the present invention is to provide disposable plastic aprons in roll form with an elimination of material waste and an attendant increase in production economy.

Still another object of the present invention is to provide disposable plastic aprons in roll form which are in a directly useable condition and configuration as dispensed from the roll.

Yet a further object of the present invention is to provide improved plastic aprons in roll form from a strip of plastic monofilm or film laminate on which indicia has been placed by embossing or printing in the manufacture of the roll.

The above and other objects are achieved and are characteristics of the roll of the present invention which, broadly described, consists of a roll of plastic aprons comprising an elongated strip of unfolded, flattened plastic film wound on a core support, said unfolded film having a plurality of perforations extending transversely thereof at predetermined spaced intervals to enable tearing discrete sheets of plastic film from the roll, said plastic film having, intermediate each pair of succesive transverse perforations, (a) adjacent to and spaced from the upper of said pair of perforations, a central cutout portion defining a neck hole of an apron, and (b) a pair of longitudinally extending cutout portions, said longitudinal cutouts being located on opposite sides of said neck hole cutout and adjacent to and spaced from an edge of said film strip, said longitudinal cutouts beginning at the upper of said pair of perforations and terminating intermediate said pair of perforations to define an apron having torso-engaging tie straps when an individual sheet of plastic film is torn from said roll.

DESCRIPTION OF EMBODIMENTS OF THE PRESENT INVENTION

Having been broadly described, the present invention will be more particularly described with reference to the attached drawings of which:

Referring to FIG. 1, numeral 1 generally designates a roll of plastic aprons formed from a flat, unfolded strip of plastic film and wound on a support core 2.

Figure 1:
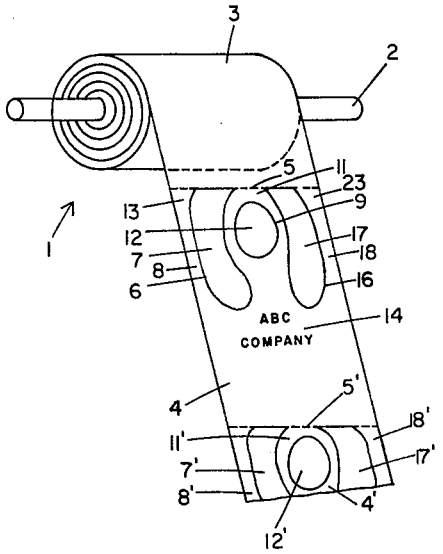
FIG. 1 is a perspective view of a roll of plastic aprons of the present invention.
Figure 2:
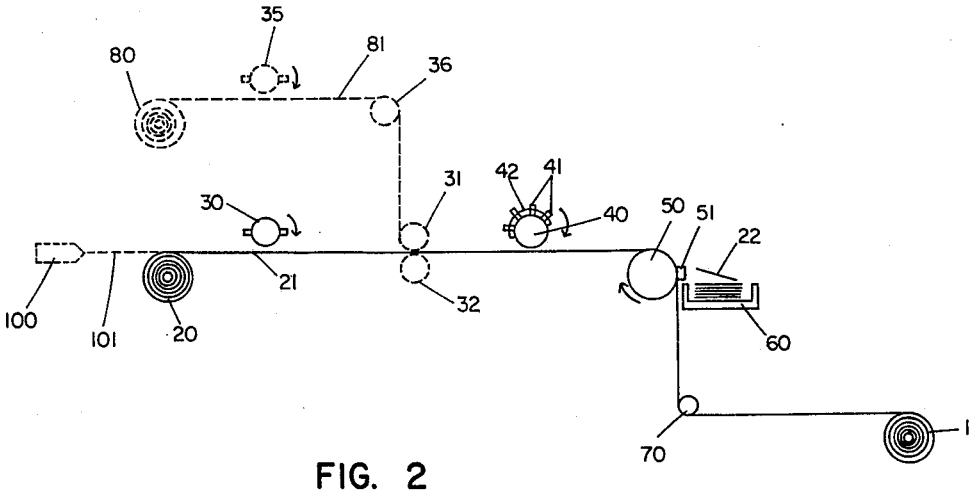
FIG. 2 is a diagrammatic view of the steps which may be utilized in the procedure for preparing the roll of the present invention.

The strip of plastic film 3 is provided throughout its length with spaced, transversely extending lines of perforations 5 and 5', with each succeeding pair of lines of perforations, such as perforations 5 and 5', defining tear lines for separation of individual aprons 4 and 4' from the roll 1 and from each other. At the upper end of each apron, eg., apron 4, a portion of the apron has been cutout along closed path 9 to define a neck hole 12 centrally located of apron 4 and spaced from perforation line 5 a distance which defines a yoke 11 of apron 4 at its top. Apron 4, beginning at perforation line 5, has further been cutout on opposite sides of neck hole 12 along closed paths 6 and 16 extending longitudinally of apron 4 and terminating intermediate perforation lines 5 and 5'. The resultant two longitudinal cutout portions 7 and 17, respectively, are spaced from the adjacent edges of film 3 to define on apron 4, when it is torn from roll 1, tie straps 8 and 18 which are adapted to be tied around the torso of a wearer of the apron. The edges of cutouts 7 and 17 suitably may be shaped to provide tie straps 8 and 18 which are of uniform or varying widths along their lengths, but cutouts 7 and 17 preferably are arcuate, curving away from the edges of film strip 3, adjacent perforation 5 to maximize the widths of tie straps 8 and 18 at 13 and 23, respectively, and improve the strength of the cutout film strip during production and winding. Apron 4 may be, and preferably is, provided with indicia, eg., advertising, as at 14, which has been applied to strip 3 by embossing or printing during its manufacture or the manufacture of roll 1.

Each successive apron on roll 1 is provided with the same arrangement of perforations and cutouts for removal of one apron from the next and from roll 1, with this arrangement being shown in FIG. 1 by the next succeeding apron to apron 4, ie., apron 4', being numbered with respect to components the same as apron 4 with the addition of a prime to each of the components' reference numerals.

Strip 3 suitably may be a plastic monofilm or a laminated plastic film in which a base plastic monofilm has superimposed thereon another plastic monofilm and/or an adsorbent coating fabric which is woven or nonwoven and having hyrophilic or organophilic properties, the presence and selection of such a second monofilm and/or fabric depending upon the desired end use and wiping qualities of the particular apron batch on a roll.

Plastic monofilms useful in forming monofilms and film laminates of strip 3 suitably may be any films or laminates conventionally employed in the manufacture of disposable aprons and bibs, and the selection of a given monofilm or laminate for a particular embodiment is largely dependent upon economics and the desired end use of the aprons. Due to such considerations, polyethylene films generally provide the preferred base monofilms; however, other suitable monofilms and laminates may be provided formed of and using polyvinyl chloride, vinylidene chloride copolymers, rubber hyrochloride, polyesters, and the like. Consistent with being able to maintain the integrity of strip 3 during manufacture and winding of roll 1, the thickness plastic films employed in producing the apron rolls of the present invention may vary over a wide range, the particular thickness employed in a given embodiment depending primarily upon the strength and wear qualities desired in the final aprons. Generally, thicknesses of the base plastic monofilms and supplemental films in laminates are in the range of from a fraction of a mil to 10 mils, and more usually, in the range of from 1 to 2 mils.

In instances wherein an absorbent coating is employed in a laminated film, the thickness of the absorbent coating fabric suitably may vary as in the case of the base film. Particular fabrics which are useful include hyrophilic fabrics formed primarily of cotton or cellulosic fibers and films, and organophilic fabrics formed of nylon, polyester, and the like fibers and films. The resultant laminates may be held together by the natural cohesive forces between the base film and absorbent coating fabric, by compatible conventional adhesives, by localized crimping of the film and fabric, heat sealing, and the like available expedients.

In the preferred embodiments of the apron rolls of the present invention wherein indicia, eg., advertising is provided on the aprons, the indicia, if not previously provided, suitably may be placed by embossing or printing or both in one step or sequentially in registration on a suitable substrate, eg., the plastic monofilm when used alone or on either the monofilm or fabric in laminates. The invention further contemplates, in embodiments wherein the monofilm is transparent, providing a substrate film or fabric upon which indicia is placed to produce other "printed" laminates.

In producing the roll of the present invention a plastic monofilm film may be produced directly from an extruder 100 or unwound from a supply roll 20 and the resultant strip 21 optionally may have indicia placed thereon at embossing or printing station 30. Strip 21 then is continuously passed through perforating and cutout station 40 having perforating means 41 and cutter means 42 shaped and contoured to produce on strip 21 perforation lines 5, 5', 5'', etc. and cutout portions 12-7-17, 12'-7'-17', 12''-7''-17'', etc., of successive apron sheets. The cutout portions suitably may be removed from strip 21 in the cutting operation, and if not, are removed in cutout removal station 50 by any suitable available means, such as by vacuum or physically punching out the same by means 51. Scrap from the cutout operation is collected as pieces 22 in reservoir 60. This feature advantageously increases the economy of the operation in instances where the base film is directly produced by an extruder, since scraps 22 may be recycled to extruder 100 with an attendant elimination of waste in the system. The resultant perforated and cutout strip is then wound on a suitable core support to produce apron roll 1. This roll produced in accordance with the present invention is adapted to dispense disposable aprons 4, 4', 4'', etc., which have neck holes and tie straps and which are in an unfolded condition adapting the aprons directly for use. By means of this feature wearers need not bother with adjusting supplemental tabs, tearing free portions, and/or unfolding the removed sheet, with their attendant difficulties and aggravations and unnecessary waste of materials characteristic of prior art aprons.

Where a laminated film strip is desired to be used, the process for preparing monofilm strips may be essentially repeated, with the exception that a second plastic film monofilm or strip of woven or non-woven fabric 81 may be withdrawn from a supply roll thereof 80, optionally treated to apply indicia thereon at embossing or printing station 35, and then superimposed on plastic monofilm 21 by suitable means, such as by passing the same together between rolls 31 and 32 which crimp, activate cohesive forces naturally present, locally head seal, eg., at spaced areas or totally along the edges, activate compatible adhesives priminarily applied to the films or fabric, or otherwise conventionally fix the films or film and fabric in juxtaposition, with the resultant laminate being perforated-cutout, treated to remove cutout portions, and then wound to produce roll 1. Alternatively, plastic film 21 may be a film laminate previously produced or film 21 may be a film laminate produced directly in the process by extrusion of both films.

What is claimed is:

1. A roll of plastic film aprons comprising an elongated strip of unfolded, flattened plastic film wound on a core support, said unfolded film having a plurality of perforations extending transversely thereof at predetermined spaced intervals to enable tearing discrete sheets of plastic film from the roll, said plastic film having, intermediate each pair of successive transverse perforations, (a) adjacent to and spaced from the upper of said pair of perforations, a central cutout and removed portion defining a neck hole of an apron, and (b) a pair of longitudinally extending cutout and removed portions, said longitudinal cutouts being located on opposite sides of said neck hole cutout and adjacent to and spaced from an edge of said film, said longitudinal cutouts beginning at the upper of said pair of perforations and terminating intermediate said pair of perforations to define an apron having torso-engaging tie straps when an individual sheet of plastic film is torn from said roll.

2. The roll according to claim 1 wherein said plastic film is a plastic monofilm.

3. The roll according to claim 1 wherein said film is a laminated plastic film.

4. The roll according to claim 3 wherein said laminated plastic film comprises a base plastic film having superimposed thereon a woven or non-woven hydrophilic fabric having absorbent properties.

5. The roll according to claim 3 wherein said laminated plastic film comprises a base plastic film having superimposed thereon a woven or no-woven organophilic fabric having absorbent properties.

6. The roll according to claim 1 wherein each of said aprons has indicia embossed or printed thereon.

7. The roll according to claim 6 wherein said plastic film is a plastic monofilm.

8. The roll according to claim 6 wherein said film is a laminated plastic film.

9. The roll according to claim 8 wherein said laminated plastic film comprises a base plastic film having superimposed thereon a woven or non-woven hydrophilic fabric having absorbent properties.

10. The roll according to claim 8 wherein said laminated plastic film comprises a base plastic film having superimposed thereon a woven or non-woven organophilic fabric having absorbent properties.

11. A process for providing a roll of plastic film according to claim 1 comprising passing an elongated strip of unfolded, flattened plastic film in contact with perforating means to produce thereon a plurality of perforations extending transversely thereof at predetermined spaced intervals to enable tearing discrete sheets of plastic film therefrom, cutting out said strip and removing the resultant cut-outs therefrom to form, intermediate each pair of successive transverse perforations, (a) adjacent to and spaced from the upper of said pair of perforations, a central cutout portion defining a neck hole of an apron, and (b) a pair of longitudinally extending cut-out portions, said longitudinal cut-outs being located on opposite sides of said neck hole cut-out and adjacent to and spaced from an edge of said film, said longitudinal cutouts beginning at the upper of said pair of perforations and terminating intermediate said pair of perforations to define an apron having torso-engaging tie straps when an individual sheet of plastic film is torn from said strip, and winding the resultant perforated and cut-out strip into a roll.

12. The process according to claim 11 wherein said plastic film is a plastic monofilm.

13. The process according to claim 11 wherein said plastic film is a laminated plastic film.

14. The process according to claim 11 wherein said plastic film comprises a base plastic film having superimposed thereon a woven or non-woven hydrophilic fabric having absorbent properties.

15. The process according to claim 11 wherein said plastic film comprises a base plastic film having superimposed thereon a woven or non-woven organophilic fabric having absorbent properties.

16. The process according to claim 11 wherein, preliminary to being wound, said strip has indicia embossed or printed therein.

* * * * *